US006786377B1

(12) United States Patent
Holden

(10) Patent No.: US 6,786,377 B1
(45) Date of Patent: Sep. 7, 2004

(54) SINGLE HAND, PAPER TOWEL DISPENSER

(75) Inventor: William Holden, Durange, CO (US)

(73) Assignee: Holdenart Inc., Durango, CO (US)

( * ) Notice: Subject to any disclaimer, the term of this patent is extended or adjusted under 35 U.S.C. 154(b) by 155 days.

(21) Appl. No.: 09/664,751

(22) Filed: Sep. 19, 2000

(51) Int. Cl.[7] ..... B26F 3/02; B65H 16/04

(52) U.S. Cl. ..... 225/106; 225/47; 225/51; 225/84; 206/409; 242/590; 242/592; 242/597; 242/599.2

(58) Field of Search ..... 225/46, 47, 51, 225/82, 84, 85, 86, 96, 96.5, 106; D6/523; 206/409; 242/590, 592, 597, 599.2, 599.3, 599.4, 419

(56) References Cited

U.S. PATENT DOCUMENTS

| | | | | | |
|---|---|---|---|---|---|
| 12,674 | A | * | 4/1855 | Duryea | 225/84 |
| 320,576 | A | * | 6/1885 | Myers | 225/85 |
| 393,629 | A | * | 11/1888 | Ehrlich | 225/85 X |
| 405,402 | A | * | 6/1889 | Ehrlich | 225/82 X |
| 436,789 | A | * | 9/1890 | Jobes | 225/85 X |
| 842,959 | A | * | 2/1907 | Kaufman | 225/86 X |
| 1,063,787 | A | * | 6/1913 | Evans | 225/85 X |
| 1,243,569 | A | * | 10/1917 | Taylor | 225/51 |
| 1,325,300 | A | * | 12/1919 | Kundtson | 225/85 |
| 1,684,190 | A | * | 9/1928 | Moser | D6/523 X |
| 2,181,207 | A | * | 11/1939 | Sanford | D6/523 X |
| D155,897 | S | * | 11/1949 | Huntington | D6/523 |
| 3,067,963 | A | * | 12/1962 | Suggs | D6/523 X |
| 4,556,160 | A | | 12/1985 | Kurz et al. | 225/67 |
| D285,850 | S | | 9/1986 | Waldron | D34/6 |
| 4,660,715 | A | * | 4/1987 | Anastos | 206/0.8 |
| 4,771,966 | A | | 9/1988 | Anderson | 242/422.5 |
| 4,858,840 | A | | 8/1989 | Kidman | 242/596.3 |
| 4,928,411 | A | * | 5/1990 | Danis et al. | 40/324 |
| 5,008,869 | A | * | 4/1991 | Dweck | 368/228 |
| D324,617 | S | | 3/1992 | McCauley | D6/518 |
| 5,411,231 | A | * | 5/1995 | Buck | 248/206.5 |
| D374,585 | S | | 10/1996 | Moon | D6/523 |
| 5,651,487 | A | * | 7/1997 | Hansen | 225/84 X |
| D383,343 | S | | 9/1997 | Goodman | D6/522 |
| D385,446 | S | | 10/1997 | Keserica | D6/523 |
| D405,992 | S | | 2/1999 | Lee et al. | D6/522 |
| 6,007,019 | A | | 12/1999 | Lynch | 242/598.2 |
| 6,267,322 | B1 | * | 7/2001 | Harmathy | 225/84 X |

* cited by examiner

*Primary Examiner*—Charles Goodman
(74) *Attorney, Agent, or Firm*—Scott Houtteman; Bradford Kile; Kile Goekjian Reed & McManus

(57) ABSTRACT

The present invention is directed to a single hand, paper towel dispenser comprising a base, a core holder operable to hold a roll of paper towel segments connected together end-to-end along perforated tear lines. The invention has a paper towel dispensing bale including mutually parallel arms that receive a paper towel strip in a general S-shaped path during a one handed dispensing operation.

21 Claims, 5 Drawing Sheets

SINGLE HAND, PAPER TOWEL DISPENSER

BACKGROUND OF THE INVENTION

This invention relates to a novel paper towel dispenser. More specifically, the present invention is directed to a, single hand, paper towel dispenser that does not require a user to hold a roll of paper towel segments with one hand in order to facilely tear off a desired length of towel with the other hand.

Paper towels are routinely used in kitchens, restaurants and other settings where food is prepared and served. No matter where food is served, paper towel dispensers are often used to dispense disposable paper towel segments to clean up spills or to clean tables and kitchen appliances. In addition, paper towel dispensers are used in garages, auto or wood working shops and in other work areas where people need to absorb or wipe-up a spill, dry a surface or simply clean and/or dry their hands.

Paper towels usually are sold in a roll on a paper core approximately one inch in diameter and eleven inches or so in width. Paper towels are formed from one or two ply sheets of absorbent paper material fashioned into eleven-by-eleven or eleven-by-thirteen inch sheets connected together end-to-end along serrated tear lines. The paper towel segments are wound upon the paper core and are usually sixty feet, or so, in overall length. One brand of such product is known as BOUNTY which is a registered trademark of the Procter & Gamble Company. This brand comes in sheets that are approximately eleven-by-eleven inches square. Another brand is referred to known as BRAWNY which is a registered trademark of the Fort James Corporation and is sold in a roll of sheets eleven inches wide by thirteen point eight inches in length joined end-to-end along serration tear lines. Still further, other brands may include towel segments or lengths of seven inches or less.

The above and other brands are often dispensed by using a simple U-shaped bracket holder which is operable to be mounted upon a vertical wall surface or beneath a horizontal wood surface such as a cupboard by wood screws. Each end of the U-shaped bracket is designed to hold one end of the paper towel core or alternatively a rod can be axially extended through the center of the paper core and mounted at its ends on the bracket or frame. At least one disadvantage of traditional paper towel dispensers is that a person needs to use both hands to dispense the paper towels. This disadvantage represents an inconvenience and difficulty for people, which is all too common, when one hand is holding a container, object of use or is otherwise soiled or occupied. In such moments the only option, in most instances, is to find a place to set the container down so that both hands are free to tear off one or more sheets of paper towels. If a user attempts to use inertia and jerk a few sheets of towel from a roll, the roll usually unreels, to a greater or less degree, leaving the user then with the task of rewinding the unused length of towel segments.

It would therefore be highly desirable to provide a means for dispensing paper towels that only requires use of a single hand to facilely tear off any length of towel desired in a reliable and convenient manner.

Additionally, traditional paper towel dispensers are often poorly designed or cheaply produced which means that a roll of paper towels often falls off the dispenser when a person attempts to tear off a paper towel segment. Therefore, it would be desirable to provide a paper towel dispenser that is rugged and reliable in design and function and will securely retain a roll of paper towels during a dispensing procedure.

In at least one further prior design, a roll of paper towels was operably received within a trough with a slit along one edge of the bottom of the trough. A free end of the roll of towels was trained through the slit and therefore operated as a dispensing unit. In this device there is nothing to brake rotation of the roll, except a users's second hand, and therefore while this design will dispense towel segments it exhibits many of the limitations of prior designs.

A least one paper towel dispenser, known in the past, that is designed to be operated with one hand, includes a pair of nesting plastic yokes that are pivotally connected to a base plate. In this design, a paper towel roll is mounted on one of the yokes and trained over a top edge of the other yoke for tearing by a downward movement. In one embodiment this tearing operation is enhanced by use of tooth-shaped projections or knife-shaped blades fitted at an edge of the second yoke to assist in separating a desired length of towel from a roll. This design, although more convenient than most traditional roll dispensers, is composed of relatively lightweight plastic and a multipart mounting mechanism for the yokes. Accordingly the design lacks ruggedness and does not take advantage of gravity to assist in a dispensing process. Moreover the tear mechanism is simply an over a yoke arm design that is lacking in its braking capacity and thus user friendliness for a one handed operation.

Still further, since paper towels are usually located in user traffic areas it would be desirable to provide a paper towel dispenser that is operable to display a user photograph or item of decoration or personal interest.

The difficulties and limitations suggested in the preceding are not intended to be exhaustive, but rather are among many which demonstrate that paper towel dispensers appearing in the past will admit to worthwhile improvement.

OBJECTS OF THE INVENTION

It is a general object of the invention to provide a single hand, paper towel dispenser that will obviate or minimize problems and achieve desired advantages of the type previously described.

It is another object of the invention to provide a single hand, paper towel dispenser wherein the dispenser may be operably mounted on vertical wood or metal surfaces or beneath horizontal surfaces such as cabinets.

It is a further object of the invention to provide a paper towel dispenser wherein a desired length of paper towel may be facilely removed by one free hand without using a second hand that may be in use, soiled or otherwise occupied.

It is yet another object of the invention to provide a single hand, paper towel dispenser wherein the dispenser continues to be highly effective in use, with only one hand, even as the size of the roll of paper towels decreases.

It is yet a further object of the invention to provide a single hand, paper towel dispenser wherein a user may operably display messages, or photographs or other items of a personal nature with the towel dispenser.

It is yet another object of the invention to provide a single hand, paper towel dispenser wherein the paper towel core is securely retained and will not allow a paper towel to slip off of the dispenser when a towel segment is torn from the dispenser.

It is a further object of the invention to provide a single hand, paper towel dispenser where the towel core may be securely held against wobble, and undesired unreeling while permitting selective rotation to permit controlled single hand dispensing of towel sheets.

It is still another object of the invention to provide a single hand, paper towel dispenser wherein said a roll of paper towels are automatically and securely braced, with the assistance of gravity, to prevent rotation as a segment of towel is torn from the roll.

It is yet a further object of the invention to provide a single hand, paper towel dispenser wherein undesired unreeling of long lengths of towel is avoided even though a selective length of a towel segment is torn off with a single, one handed, stroke.

Still further, it is an object of the invention to provide a single hand paper towel dispensing system that during the sequence of tearing off a towel sheet with a single hand will concomitantly leave a short segment of one length of paper towel to grasp for a subsequent dispensing operation.

BRIEF SUMMARY OF A PREFERRED EMBODIMENT OF THE INVENTION

A preferred embodiment of the invention, which is intended to accomplish at least some of the foregoing objects, includes a single hand, paper towel dispenser comprising a base, a core holder operable to rotatably hold a roll of paper towel segments connected together end-to-end along perforated tear lines. A single hand, paper towel dispensing bale, having generally parallel bale rods, receives a length of paper towel in an "S-shaped" dispensing path and operably secures the towel roll against rotation and concomitantly provide a tear bar such that a segmented paper towel roll can be facilely dispensed with one hand.

BRIEF DESCRIPTION OF THE DRAWINGS

Other objects and advantages of the present invention will become apparent from the following detailed description of preferred embodiments thereof taken in conjunction with the accompanying drawings, wherein.

DETAILED DESCRIPTION

Context of the Invention

Figure 1:
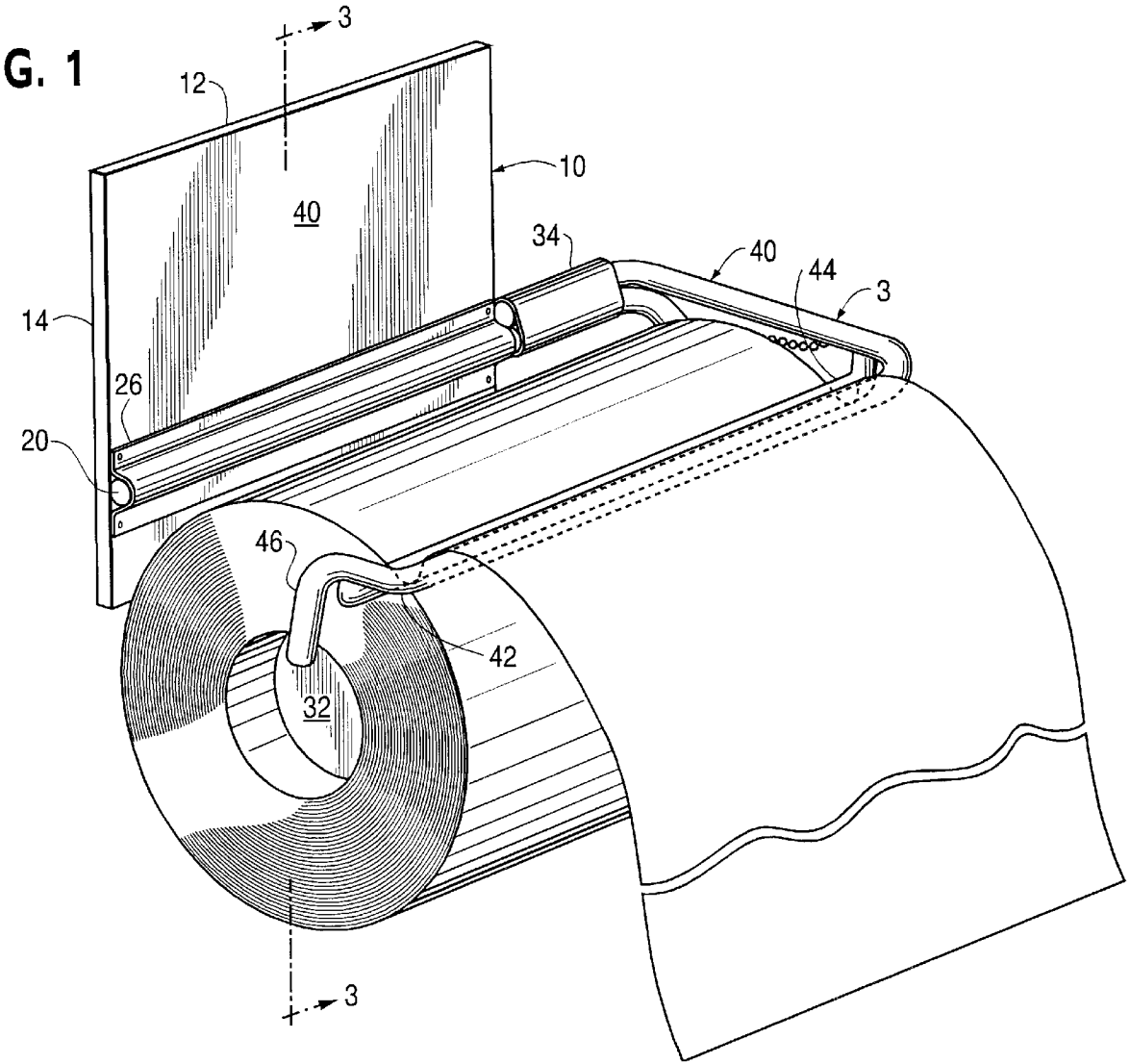
FIG. 1 is an axonometric view of a single hand, paper towel dispensing device in accordance with one preferred embodiment of the invention.
Figure 6:
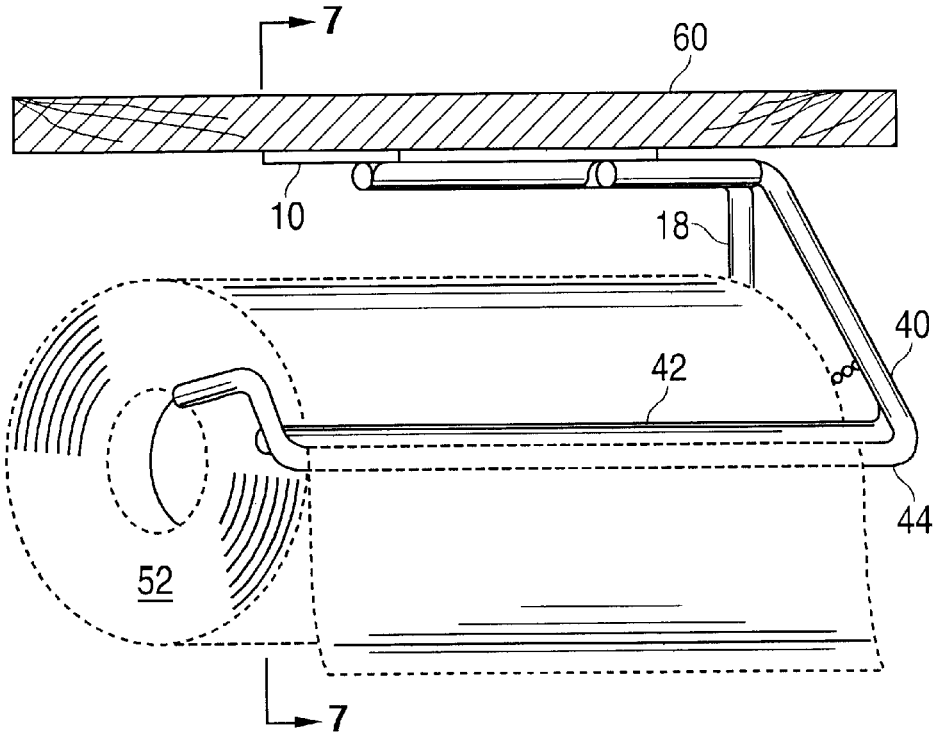
FIG. 6 is perspective view of another embodiment of the present invention intended to be mounted to a horizontal, generally planar surface, such as beneath a conventional wood kitchen cabinet.

Referring now to the drawings, wherein like reference numerals indicate like parts, and particularly to FIGS. 1 and 6, there will be seen the general operating context of the subject invention.

The invention is directed to a single hand, paper towel dispenser that comprises a base for mounting said dispenser, a core holder operable for holding a roll of segmented paper towel sheets, and a single hand, paper towel dispensing bale comprised of a pair of mutually parallel arms operable for dispensing said paper towel sheets with one hand. The paper towel dispenser can be mounted on a generally vertical surface or alternatively mounted on the bottom of a surface, i.e. the bottom of a kitchen cabinet. In addition the base can be fitted with a magnet to enable the base to be releasable affixed to a vertical metallic surface such as a refrigerator exterior side wall. In all of these mounting arrangements, a bale having a bite with mutually parallel rods is used to allow a user to load a roll of paper towels onto the core holder and train a free end of the roll in an S-shaped pattern through the bale.

To dispense a segment of paper towel, one pulls the paper towel through the S-shaped path of the mutually parallel arms of the bale member until a perforation line is a few inches past the outermost bale arm. A smooth pull downwardly, and at an angle, serves to brake the roll against a wall surface and by the inner arm of the bale to prevent roll rotation during the tearing operation. The result is a smooth removal of a desired number of sheets with one hand and concomitant positioning of a neat short segment of towel for grasping with one hand during the next dispensing operation.

Single Handed Paper Towel Dispensing Apparatus

Figure 2:
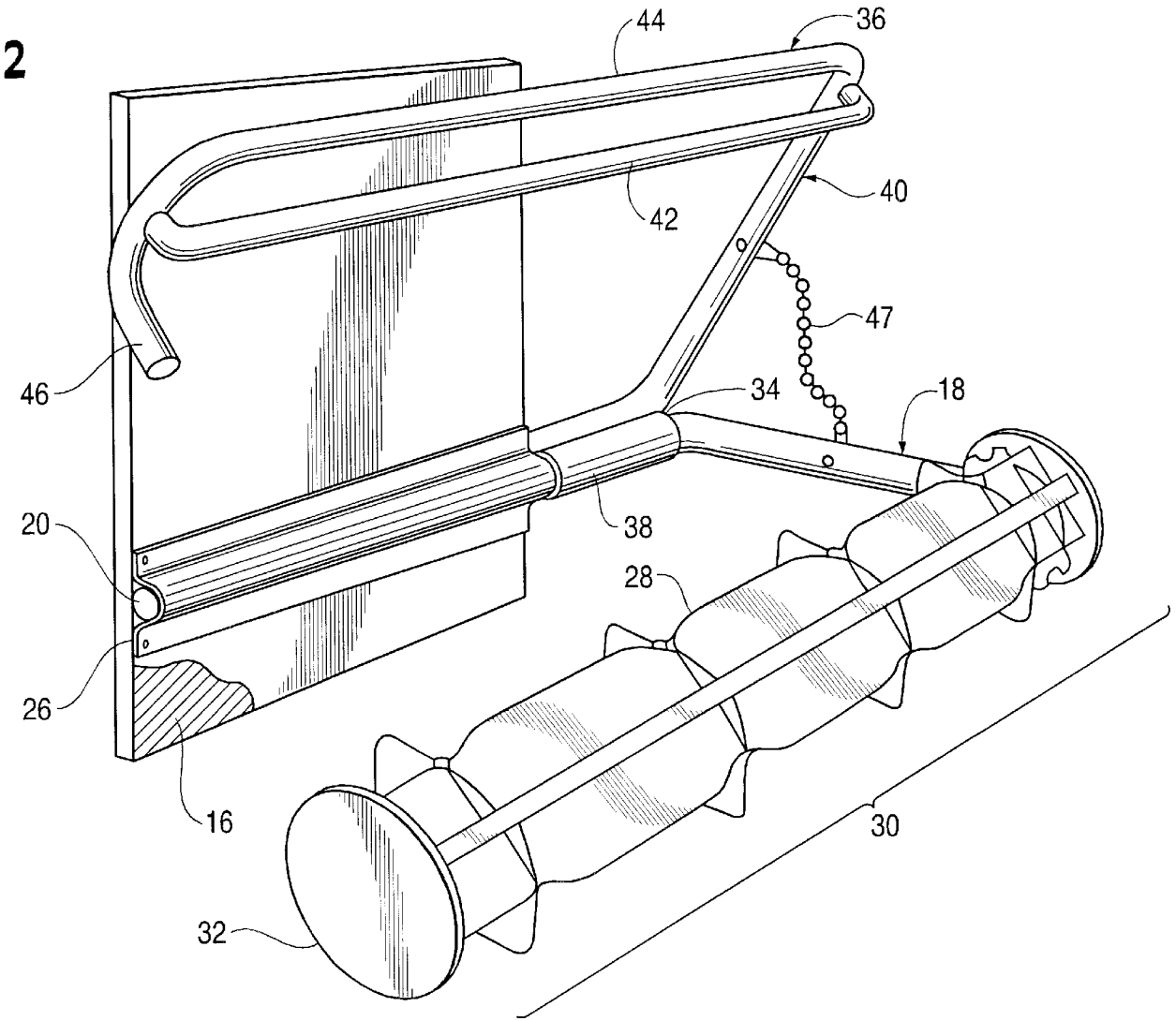
FIG. 2 is another perspective view of the embodiment of the subject invention, depicted in FIG. 1, with the components of the invention shown assembled together without application of a roll of paper towels to reveal the structural details of the invention.

Turning now specifically to FIGS. 1 and 2 a presently preferred embodiment of the invention includes a base member 10 configured as a relatively thin solid rectangle which is operable to mounted on a vertical surface. The base member has a length 12 of about the length of the width of a conventional roll of paper towels. The height 14 is preferable somewhat less than the length. In a presently preferred embodiment the base is approximately six inches long and the height is approximately four inches. Mounting apertures (not shown) may be fashioned through the base to receive wood screws in a conventional manner. In a preferred form the base is fabricated as a generally rectangular stamped metallic shell and as depicted in FIG. 2 the shell carries a solid rectangular permanent magnetic 16. Alternatively, the base may be round, oval, square or even irregular as desired. Accordingly the base may be releasable mounted on the exterior of any metallic surface such as the side wall, or even front, of a refrigerator.

The base 10 operably serves to carry a generally U-shaped heavy gauge wire core holder 18. In this connection the term heavy gauge as used in this application preferably comprises a solid wire member having a nominal diameter of one quarter inch or so. Other materials and shapes such as tubular plastic rods are envisioned and may be used, however, a heavy wire composed of painted low grade steel, or even stainless steel, is presently preferred. The U-shaped wire core holder 18 has one of its arms 20 pivotally mounted on the base 10. This can be accomplished with an elongate sleeve segment 26 stamped out of the metallic member 10 or individual parallel mounting brackets, not shown in FIG. 1.

The core holder 18 has a second arm, parallel to the first, that serves to pivotally carry a paper towel, core carrying member 28. The core carrying member 28 may be formed with a number of shapes but is preferably a molded plastic unit that has voids throughout its length but generally is fashioned in the shape of a cylinder 30. The core carrying member 28 securely engages the interior paper core of a roll of towels without relative rotation but the core carrying member 28 is pivoted upon and free to rotate on the second arm of the core holder 18. The diameter of the cylinder 30 can vary but is generally the size of a conventional paper core of the roll of paper towels. The distal end of the core carrying member ends with a disc 32 that is dimensionally operable to fit within the paper core of a roll of towels as shown in FIG. 1.

In addition to the core holder 18 the base 10 operably carries, via a pivotal connection 34 with the core holder 18 a single hand paper towel dispensing bale 36. The dispensing bale is preferably connected to the core holder 18 by a pivot sleeve 38 but may also be pivotally connected directly to the base 10 as desired. The dispensing bale is composed of a heavy gauge solid wire construction of a nominal quarter inch in diameter so that it is rugged and carries a degree of weight to utilize gravity to pin a paper towel roll against a vertical wall surface or brake rotation in a manner that will be discussed in detail below.

The dispensing bale is, again, a generally U-shaped member 40 fashioned with a pair of mutually parallel arms 42 and 44. The first arm 42 is operable to extend transversely across and contact an exterior surface of a roll of paper towels, see FIG. 1, mounted upon the core holder 18. A second arm 44 operably extends transversely across the direction of unreeling of a roll of paper towels and is mutually parallel with, but spaced from, said first arm 42. In combination, the pair of bale arms 42 and 44 provide a path of unreeling of the free end of a roll of paper towels where the free end is entrained or fed under the first arm 42, up, over and around the arm and then reversibly folded up and over the second arm 44 in a general S-shaped path as shown in FIG. 1.

As noted above the rolls of paper towels are usually formed with transverse serrated or score lines across the roll of towels at eleven to thirteen inches or so. Accordingly, if a length of paper towel is withdrawn out horizontally, or unreeled a desired length, by a user's free hand, note FIG. 1, until a score line is an inch or two beyond the second arm, downward angled motion by the user will pull the second bale arm 44 down and the attached first bale arm will be pulled into braking registry with the surface of the roll of paper towels. In addition, downward motion of the bale 18 serves to pin the other side of the paper towel against a vertical surface carrying the base 10.

During the unreeling and tearing process the roll of paper towels is retained on the core support by the provision of a generally radially extending extension 46 at a distal end of the second bale arm 44.

Figure 4:
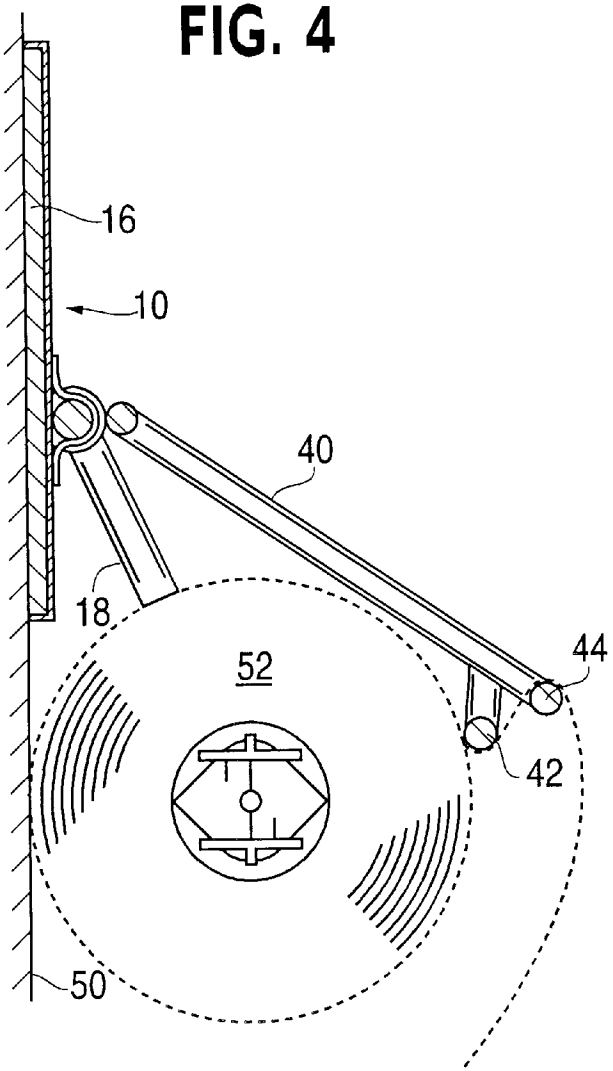
FIG. 4 is a side, cross-sectional view of the present invention, similar to the view depicted in FIG. 3, however, where the roll of paper towel segments has been partially used and the paper towel dispensing bale lies in a slightly downward-angled position but still being operable to pin the roll against the vertical surface as a paper towel is torn from the front of the roll with one hand.
Figure 3:
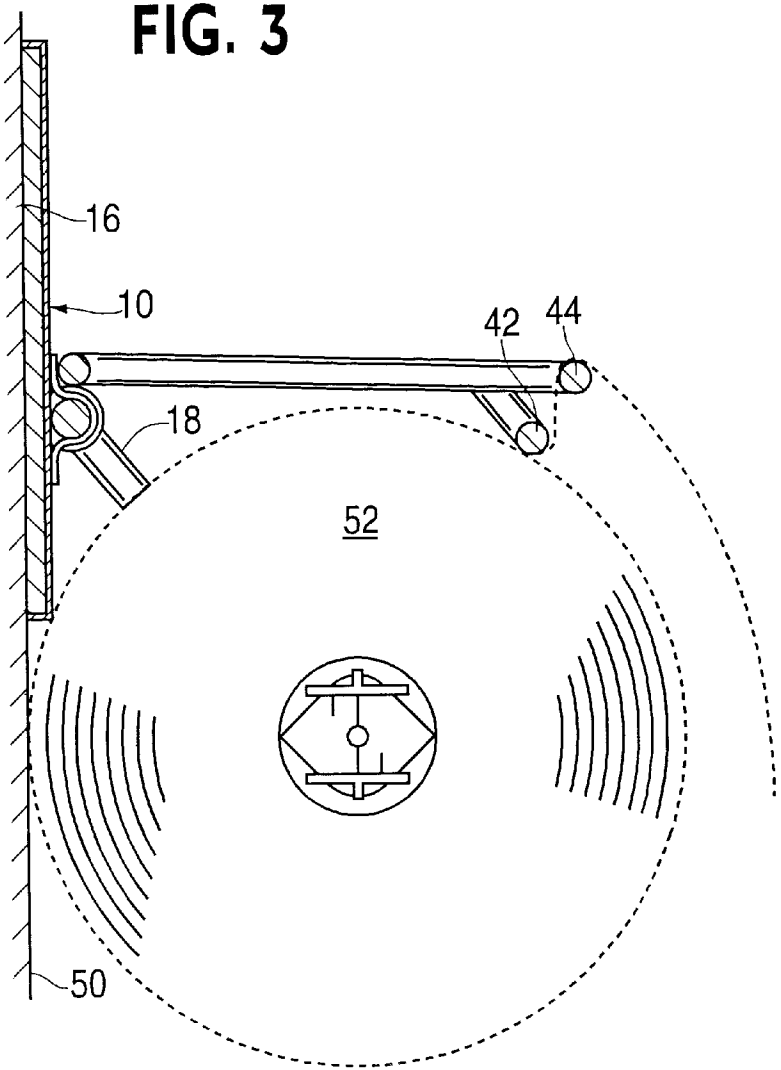
FIG. 3 is a side, cross-sectional view, taken along section line 3—3, in FIG. 1 and depicts a roll of paper towel segments positioned such that a single hand, paper towel dispensing bale lies in a generally horizontal position on a new roll of paper towel segments and the paper towel is entrained through the bale is a generally S-shaped pattern.

Turning now to FIGS. 3 and 4 there will be seen cross sectional views of the subject invention mounted onto a metallic vertical surface 50. Specifically, FIG. 3 is a cross sectional view taken along section line 3—3 in FIG. 1 and depicts a new roll of paper towels 52 mounted on the core holder or carrying member 28 of the subject invention. First, it will be seen that the core holder 18 pivots the side surface of the roll of towels into the vertical surface and that acts as a brake to casual unreeling of the roll. Second, the sheets of paper towels are entrained or fed beneath the first bale arm 42, reversed around the first bale arm and up and over the second bale arm 44 and then downward by gravity for dispensing. The weight of the paper towel dispensing bale 40, as operably pivoted from the base 10, further acts to pin the roll of towels from casual rotation by the weight of the bale 40 again attempting to pivot the roll of paper towels into the vertical wall surface 50.

Although, as stated above, it is preferable for the core carrying member 28 to securely engage the interior surface of a core of paper towels, the subject invention will also operate, although not as facilely, with a core carrying member that has a diameter less than the interior diameter of the core of paper towels and thus permits relative rotation of the roll of paper towels upon the core carrying member.

After a roll of paper towels is loaded upon the core carrying member 28, the roll of paper towels can be retained on said core carrying member 28 by the provision of a generally radially extending extension 46 at a distal end of the second bale arm 44. The subject invention also advantageously operates with a chain element 47 fastened between the paper towel dispensing bale 40 and the core holder arm 18 (note particularly FIG. 2). This chain enables a new roll of towels to be mounted onto the core carrying member with one hand merely by lifting the dispensing bale 40 with the other hand.

In a dispensing operation, if the distal or free portion of the roll of towels is pulled up and out, unreeling motion is facilely achieved with one hand. When a desired length is withdrawn from the roll, such that a tear line is exposed an inch or two, beyond the bale arm 44, and it is desired to sever the towels selected from the rest of the roll, the desired length is pulled downward and slightly at an angle. The pulling movement or motion serves to pin the first bale arm 42 into braking contact with the exterior surface of the roll. Moreover, in the embodiment of the invention depicted in FIGS. 1–4 an exterior surface of the roll of towels is pulled into enhanced engaging contact with the wall surface 50. The combination of the above provides a secure and reliable brake to unwanted unreeling of the towel during a dispensing operation.

In FIG. 4, approximately 50% of the roll 52 of paper towels has been used. The same physical braking relationships, however, exist with respect to the wall surface 50, the pivoted core holder 18 and the paper towel dispensing bale 40. As explained above, the roll 52 is again effectively braked against rotation during a dispensing operation, which may be facilely performed with a user's single hand.

Figure 5:
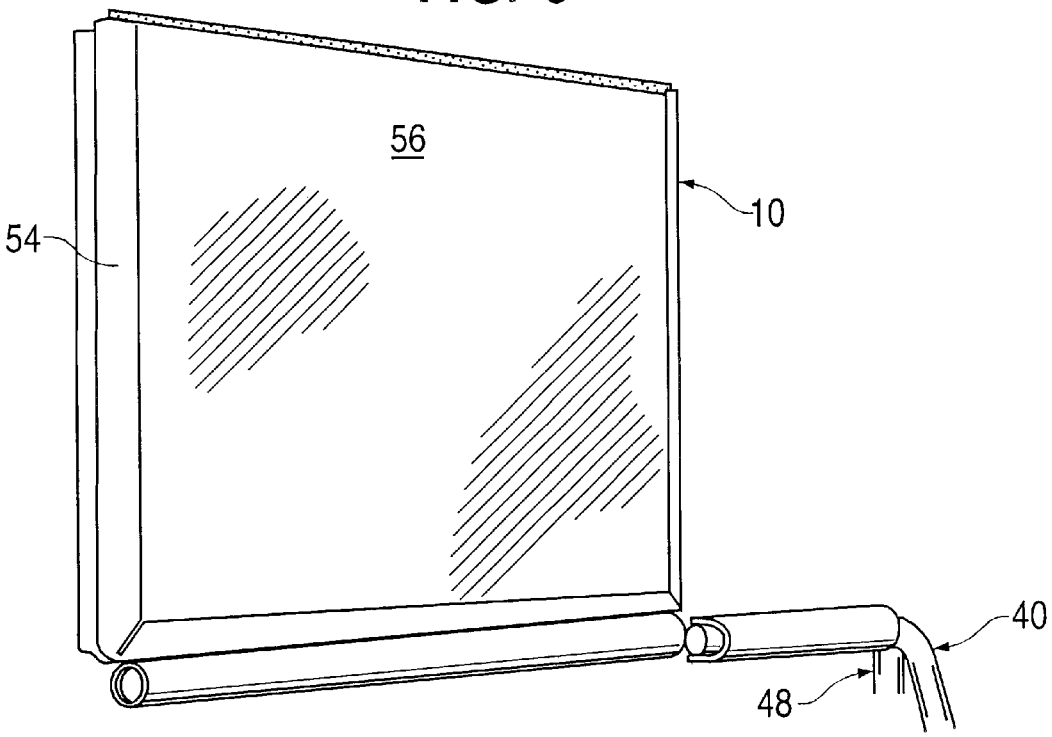
FIG. 5 is a schematic view of a base element, in accordance with the present invention, where a transparent cover is used to display pictures or other user insignia.

In the embodiment of the invention depicted in FIG. 5 the base member 10 is fitted with a generally U-shaped frame 54 that operably fits around three sides of the base to form a U-shaped channel. A clear panel 56 of glass or plastic is slid into the frame 54 and a user is then free to slide a picture or message item behind the glass for display. In this embodiment the core holder 18 is then pivotally mounted to the base edge of the frame so that the see-through surface 56 is not obstructed. The operation of the paper towel dispenser, including the core holder 18 and the paper towel dispensing bale operate the same as discussed above in connection with other Figures.

Figure 7:
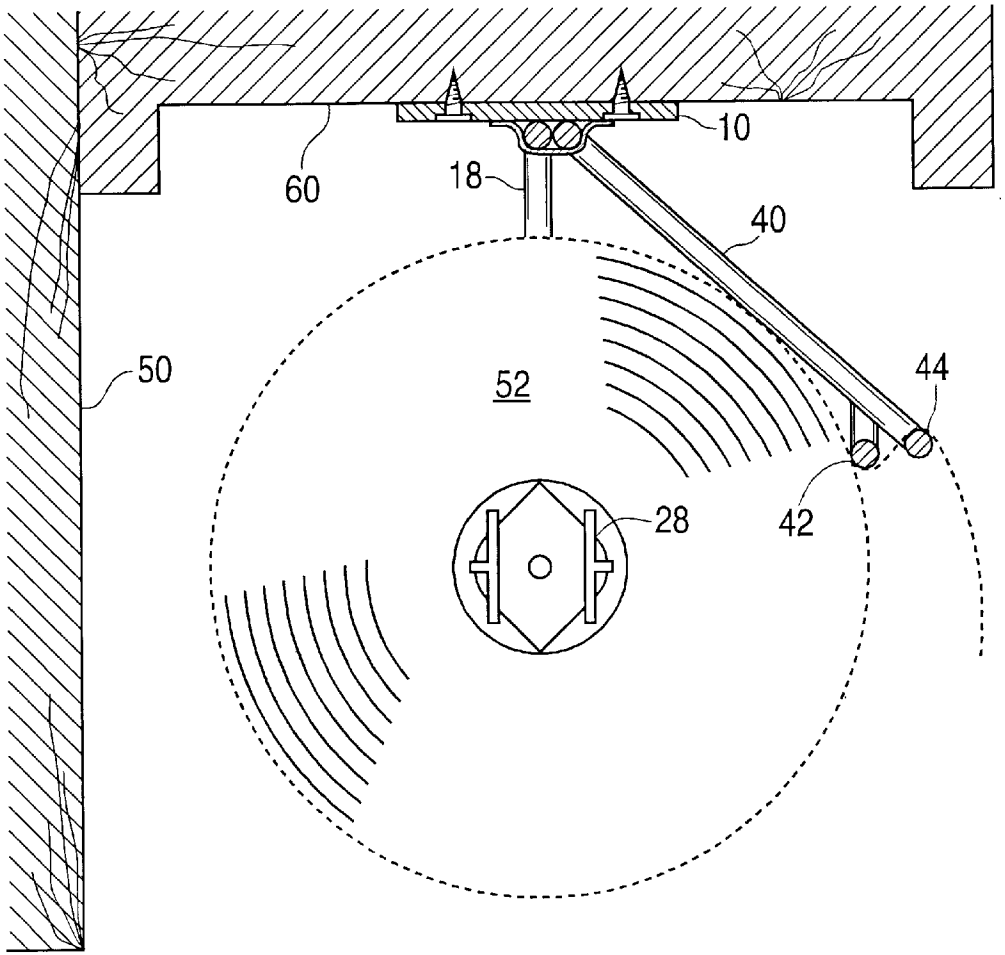
FIG. 7 a cross-sectional view of the embodiment of the invention depicted in FIG. 6, taken along section line 7—7.

Referring now to FIGS. 6 and 7 there will be seen another embodiment of the invention. In this embodiment the paper towel dispenser is intended to be mounted beneath a cabinet 60 which is in turn mounted upon a vertical wall surface 50. In this embodiment the components are essentially the same as discussed above in the sense of a core holder 18 and a single hand, paper towel dispensing bale 40 being operably connected to a base 10 to pivot with respect to the base. In this embodiment, however, the core holder 18 is not pivotally connected to the base but is rather fixedly mounted against rotation with respect to the base. Accordingly downward motion of a dispensed sheet of paper towel will pivot the paper towel dispensing bale against the surface of the roll 52 of towel segments and brake unreeling as the towel segment is facilely torn off with one hand of a user.

SUMMARY OF MAJOR ADVANTAGES OF THE INVENTION

After reading and understanding the foregoing description of preferred embodiments of the invention, in conjunction with the illustrative drawings, it will be appreciated that several distinct advantages of the subject single hand, paper towel dispenser are obtained.

The present invention presents numerous advantages over traditional paper towel dispensers and enables a user to reliably unreel a desired length to paper towel segments and sever the desired length with one hand. The subject invention is composed of heavy gauge wire of approximately one quarter inch in diameter which provides not only strength to the structure but a significant gravity component that assists in braking action during removal of a length of towel segments from a roll. Alternatively other materials may be used, such as plastic, which will fall within the purview of the subject invention. The paper towel dispensing bale with mutually parallel arms 42 and 44 enables the paper towel to be entrained or fed in an S-shaped dispensing path that operable securely brakes the towel roll as an individual or series of segments are torn off of the roll.

The subject invention provides a reliable system of using a single hand to tear off sheets of paper towels without touching or soiling other sheets of the roll of paper towels with a user's other hand.

The paper towel core carrying member 28 securely engages the interior surface of a cylindrical paper towel core while permitting facile rotation and dispensing of the roll of paper towels without relative rotation between the care member 28 and the core of a roll of towels.

The base may be advantageously mounted on a wood or plastic surface with screws or on a metallic surface by utilizing a permanent magnet. The base may further be utilized to display personal or decorative pictures or designs or information for ready reference.

The foregoing preferred and alternative embodiments of the invention, and advantages of the invention, are not intended to be exhaustive but rather are illustrative of the invention and should not be construed to be limitations on the invention as defined in the following, claims.

What is claimed is:

1. A single hand, paper towel dispenser comprising:

a base operable to be mounted upon a generally planar surface;

a core holder for a roll of paper towel segments connected together end-to-end along transverse perforated tear lines, said core holder having a central longitudinal axis and being connected to said base, said core holder being operable to rotatably support the roll of paper towel segments; and a single hand, paper towel dispensing bale connected to said base forming a bale pivot operable to pivot toward and away from said central longitudinal axis of said core holder, said bale having a pair of mutually parallel arms fixed with respect to each other and extending in a posture generally parallel with said central longitudinal axis of said core holder, said pair of mutually parallel arms comprising, a first brake arm operable to extend transversely across the roll of paper towel segments mounted upon said core holder and, during a paper towel dispensing operation, said brake arm contacts an exterior surface of the roll of paper towel segments, and a second actuating arm operable to extend transversely across the direction of unreeling of the roll of paper towel segments and being spaced from said first brake arm and away from the exterior surface of the roll of paper towel segments, said second actuating arm providing a tear bar such that paper towel segments can be facilely trained beneath said first brake arm, and over said second actuating arm such that unreeling of a desired number of the paper towel segments can be achieved with one hand and downward movement of the paper towel segments against the second actuating arm will concomitantly force said first brake arm to be pressed against the exterior surface of said roll of paper towel segments to stop rotation of the roll and effect lateral tearing of the desired number of paper towel segments over said second actuating arm along one of the tear lines adjacent to said second actuating arm.

2. A single hand, paper towel dispenser as defined in claim 1 wherein:

said base comprises a solid, rectangular mounting pad having a flat surface operably adjoining said generally planar surface to provide a stable support for said core holder and said single hand, paper towel dispensing bale.

3. A single hand, paper towel dispenser as defined in claim 2 wherein:

said base comprises a solid, rectangular mounting pad having a plurality of mounting apertures operable to support mounting of said core holder and said single hand, paper towel dispensing bale.

4. A single hand, paper towel dispenser as defined in claim 2 wherein:

said base comprises a solid, rectangular mounting pad fitted with a magnet operable for mounting said paper towel dispenser to a metallic, generally vertical, surface.

5. A single hand, paper towel dispenser as defined in claim 2 wherein:

said base comprises a solid, rectangular mounting pad fitted with a transparent cover operable for displaying photographs and other insignia on a visible generally planar surface of said base.

6. A single hand, paper towel dispenser as defined in claim 1 wherein:

said core holder is formed from a generally U-shaped heavy gauge wire having a first holder arm mounted upon said base and a second holder arm, extending generally parallel with said first holder arm and being operable for receiving a core of a roll of paper towel segments.

7. A single hand, paper towel dispenser as defined in claim 6 wherein:

said first holder arm is pivotally mounted upon said base and said second holder arm carries a core carrying member, said core carrying member being pivotally mounted upon said second holder arm.

8. A single hand, paper towel dispenser as defined in claim 7 wherein:

said core carrying member is formed having a generally cylindrical exterior configuration for releasable but firmly engaging the interior surface of a cylindrical core of the roll of paper towel segments such that in operation there is no relative rotation between said core carrying member and said cylindrical core of the roll of paper towel segments.

9. A single hand, paper towel dispenser as defined in claim 1 wherein:

said single hand, paper towel dispensing bale is formed from a segment of heavy gauge wire formed in a generally U-shaped configuration wherein a first wire member is pivotally mounted with respect to said base and said pair of mutually parallel arms are also composed of a heavy gauge wire and said second actuating arm terminating in a free distal end that is bent approximately ninety degrees with respect to the transverse extent of said second actuating arm and being operable to retain a roll of paper towel segments on said core holder during a process of unreeling and tearing of the desired number of the paper towel segments from the roll.

10. A single hand, paper towel dispenser as defined in claim 1 wherein:

said paper towel dispensing bale is attached to said core holder by a chain element fastened between said paper towel dispensing bale and said core holder.

11. A single hand, paper towel dispenser as defined in claim 1 wherein:

said paper towel segments can be facilely trained beneath said first arm, reversibly folded partially around said first brake arm and over said second actuating arm.

12. A single hand, paper towel dispenser as defined in claim 1 wherein:

said paper towel segments can be facilely trained beneath said first arm, around said first arm and over said second arm n a general S-shaped path.

13. A single hand, paper towel dispenser comprising:

a mounting base operable for mounting said paper towel dispenser to a generally planar surface;

a paper towel core holder connected to said base and being operable for holding a roll of paper towel segments of a desired number and length connected end to end at perforated junctions locations; and a dispensing bale member pivotally mounted with respect to said mounting base and being operable to pivot toward and away from said mounting base, said dispensing bale member comprising dual, mutually parallel, and actuating arms fixed with respect to each other having a slot there between operable for receiving and dispensing paper towel segments when a connected series of paper towel segments are fed in a generally S-shaped path beneath the first of said dual arms of said dispensing bale, through said slot and up and over the second of said dual arms of said dispensing bale such that a downward and lateral motion applied to said connected series of paper towel segments, applies pressure to said second arm of said dispensing bale member which concomitantly serves to apply braking pressure from said first arm against the roll of paper towel segments to stop rotation of said roll of paper towel segments while a tear is made along a perforated junction to dispense a desired number of connected series of paper towel segments with one hand.

14. A single hand, paper towel dispenser as defined in claim 13 wherein:

said mounting base comprises a rectangular mounting pad and a magnet operable for releasable affixing said mounting base to a metallic surface.

15. A single hand, paper towel dispenser as defined in claim 13 wherein:

said mounting base comprises a solid, rectangular mounting pad and a transparent cover operable for displaying photographs or other insignia on the mounting base.

16. A single hand, paper towel dispenser as defined in claim 13 wherein:

said core holder connected to said mounting base is operably connected to said mounting base in a fixed, stationary position to rotatably support the roll of paper towel segments along a central longitudinal axis.

17. A single hand, paper towel dispenser as defined in claim 16 wherein:

said bale member is composed of heavy gauge wire fashioned to form a dual generally U-shaped configuration and being mounted to pivot toward and away from a central axis of said core holder and being pivoted toward said one of said parallel arms having a generally radially extending extension at a distal end thereof to retain a roll of paper towel segments on said core holder during dispensing of paper towel segments from said dispenser.

18. A single hand, paper towel dispenser as defined in claim 17 wherein:

one arm of said pair of mutually parallel arms being operable to provide a brake against the exterior surface of a roll from rotating on said core holder as downward tearing force is applied on a paper towel segment trained over the other of said pair of mutually parallel arms.

19. A single hand, paper towel sheet dispenser comprising:

a base operable to be mounted upon a generally planar surface;

a core holder for a roll of paper towel segments connected together end-to-end along transverse serrated tear lines, said core holder being connected to said base, said core holder being operable to rotatably support the roll of paper towel segments; and a single hand, paper towel sheet dispensing bale operably connected to said core holder and being free to pivot with respect to said core holder, said dispensing bale having a pair of mutually parallel bars extending in a posture generally parallel to a central longitudinal axis of said core holder and transverse to the roll of paper towel segments when said roll is operably mounted upon said core holder, and said pair of mutually parallel bars comprising, a brake bar operable to extend transversely across and, during a paper towel dispensing operation, said brake bar contacts an exterior surface of the roll of paper towel segments mounted upon said core holder, and a tear bar operable to extend transversely across a direction of unreeling of the roll of paper towel segments mounted upon said core holder and being spaced from said brake bar such that a free end of said roll of paper towel segments is facilely trained beneath said brake bar and over said tear bar, wherein unreeling of a desired number of paper towel segments is achieved with one hand to a position with a transverse serration line slightly past an outer surface of said tear bar and then angular movement of the desired length of paper towel segments against said tear bar will concomitantly force said brake bar to be pressed against the exterior surface of said segmented paper towel roll to brake rotation of the roll and effect lateral tearing of the desired number of paper towel segments.

20. A single hand, paper towel sheet dispenser as defined in claim 19 wherein:

said core holder being pivotally connected to said base so that a roll of paper towel segments, when mounted on the core holder, is operable to pivot with respect to said base.

21. A single hand, paper towel sheet dispenser comprising:

a base operable to be mounted upon a support member;

a core holder bale operable to receive a roll of paper towel segments connected together end-to-end along transverse serrated tear lines, said core holder having a central longitudinal axis and being connected to said base; and a single hand, paper towel sheet dispensing bale operably connected to said core holder and being free to pivot toward and away from said core holder, said bale having a pair of mutually parallel bars and extending in a posture generally parallel with said central longitudinal axis of said core holder, said pair of mutually parallel bars comprising, a brake bar operable to extend transversely across and, during a paper towel dispensing operation, said brake bar will contact an exterior surface of the roll of paper towel segments mounted upon said core holder; and a tear bar connected to but spaced from said brake bar and being operable to extend transversely across the direction of unreeling of the roll of paper towel segments and being spaced from said brake bar away from the roll of paper towel segments, wherein said paper towel segments can be facilely trained beneath said brake bar and over said tear bar such that unreeling of paper towel segments can be achieved with one hand to a desired number of segments and angled movement of the unreeled number of segments against the tear bar will concomitantly force said brake bar against the exterior surface of said roll of paper towel segments to stop rotation of the roll and effect lateral tearing of the desired number of paper towel segments with one hand.

* * * * *

UNITED STATES PATENT AND TRADEMARK OFFICE

CERTIFICATE OF CORRECTION

PATENT NO. : 6,786,377 B1
DATED : September 7, 2004
INVENTOR(S) : William Holden It is certified that error appears in the above-identified patent and that said Letters Patent is hereby corrected as shown below:

Title page,
Item [75], Inventor, "Durange" should read -- Durango --.
Item [73], Assignee, "Holdenart Inc." should read -- HoldenArt, Inc. --.

Signed and Sealed this

Eleventh Day of April, 2006

JON W. DUDAS
*Director of the United States Patent and Trademark Office*